United States Patent [19]

Lorenz

[11] Patent Number: 4,856,707

[45] Date of Patent: Aug. 15, 1989

[54] CONTAINER FOR FOOD PRODUCTS

[75] Inventor: Achim R. Lorenz, Marietta, Ga.

[73] Assignee: MacMillan Bloedel Containers, Atlanta, Ga.

[21] Appl. No.: 229,499

[22] Filed: Aug. 8, 1988

[51] Int. Cl.[4] ..... B65D 5/28

[52] U.S. Cl. ..... 229/114; 229/23 R; 229/125.19; 229/125.29; 229/901

[58] Field of Search ..... 229/114, 125.27, 901, 229/902, 906, 199, 23 R, 23 BT, 125.19

[56] References Cited

U.S. PATENT DOCUMENTS

| | | | |
|---|---|---|---|
| 2,316,457 | 4/1943 | Royce | 229/901 |
| 3,027,062 | 3/1962 | Huss et al. | 229/23 R |
| 3,410,475 | 11/1968 | Wagner | 229/178 |
| 3,926,362 | 12/1975 | Beck et al. | 229/901 |
| 4,339,068 | 7/1982 | Brauner | 229/904 |
| 4,362,265 | 12/1982 | Williams | 229/901 |
| 4,431,128 | 2/1984 | Dirico | 229/904 |
| 4,444,354 | 4/1984 | Staelgraeve | 229/901 |
| 4,470,538 | 9/1984 | Heathcock et al. | 229/23 R |
| 4,474,324 | 10/1984 | Forbes, Jr. | 229/23 BT |

FOREIGN PATENT DOCUMENTS

| | | | |
|---|---|---|---|
| 873182 | 6/1971 | Canada | 229/149 |

*Primary Examiner*—Stephen Marcus
*Assistant Examiner*—Jes F. Pascua
*Attorney, Agent, or Firm*—Beveridge, DeGrandi & Weilacher

[57] ABSTRACT

A container suitable for packaging food items such as hamburgers or fried chicken is disclosed. The container includes two complementary container pieces, namely a tray and a cover closable over the tray. Each piece has opposing sidewalls provided with tip portions which project longitudinally outwardly over the central portion of each adjacent sidewall without such tip portions to pass through a plane determined by the central portion of each such adjacent sidewalls. The tip portions of each complementary piece interlock to securely close the container.

25 Claims, 3 Drawing Sheets

FIG. 6
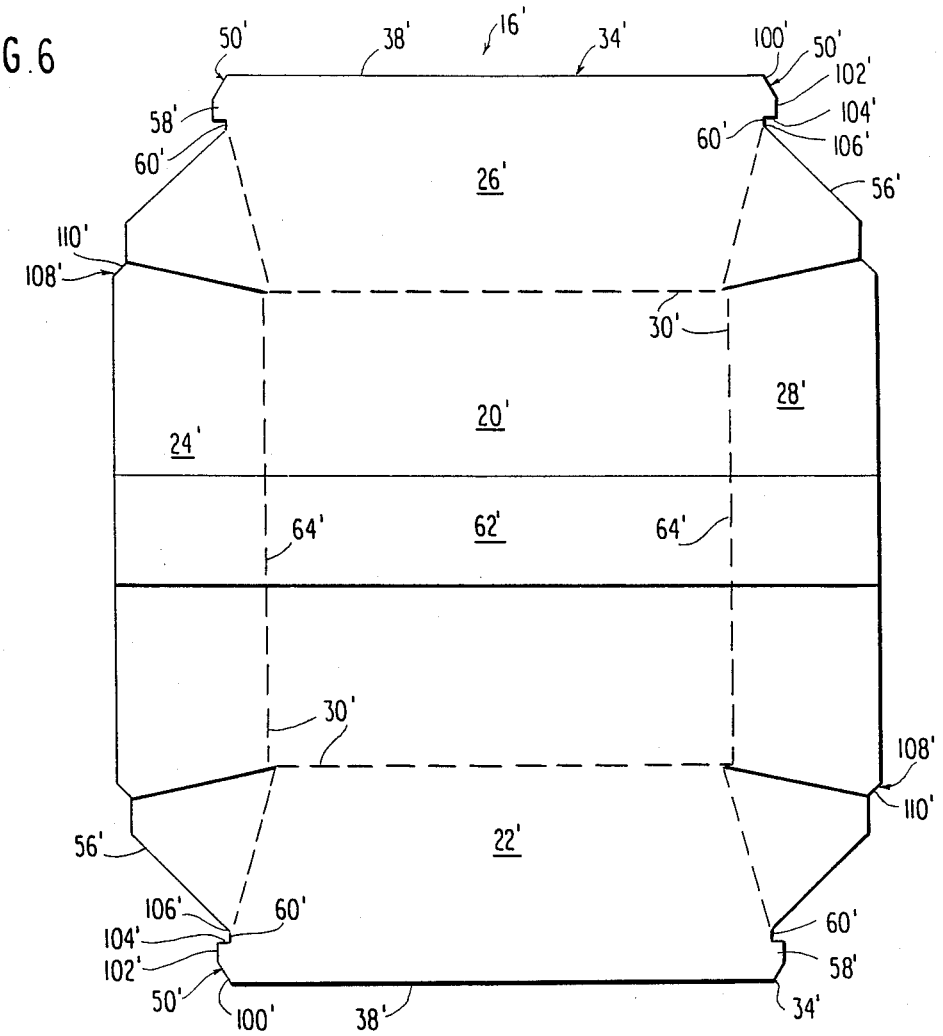
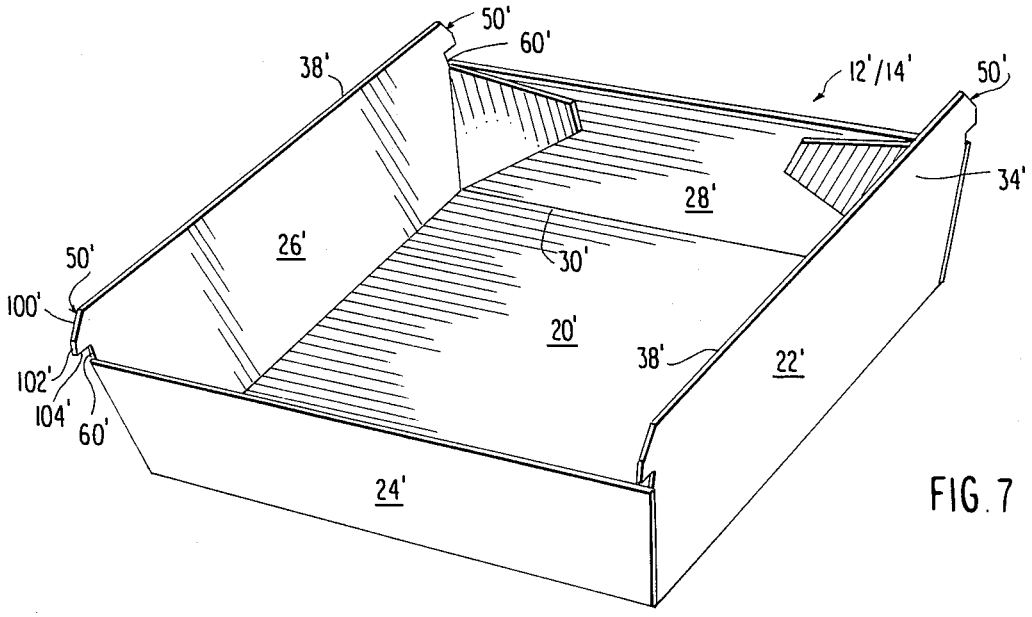
FIG. 7

CONTAINER FOR FOOD PRODUCTS

BACKGROUND OF THE INVENTION

The present invention pertains to a container suitable for packaging food items which container comprises two complementary container pieces, a tray and a cover closable over the tray, with each container piece having opposing sidewalls with tip portions which project longitudinally outwardly over the central portions of such sidewalls to interlock with like tip portions on the complementary piece to securely close the container.

In the art of packaging emphasis has been placed on constructing two-piece, tray-type cartons or containers for items, particularly food items, which may be easily joined together to enclose the item. Accordingly, U.S. Pat. No. 3,027,062 discloses a combination tray and cover adapted for interlocking to contain an article. According to the patentee, the tray and cover preferably are constructed from blanks of identical size and contour. The sidewalls of each tray and cover piece include, located at the top edge thereof, a locking tab having a male portion delineated by a slit and a guide tab. To interlock the tray and cover, the cover is positioned over the tray so that the locking tabs of the two pieces are placed in contact. Thereafter, the cove is rotated with respect to the tray until the male portions of the locking tabs of each piece lockingly engage in the slits of the other piece. The cover can be removed by twisting in the opposite rotational direction.

U.S. Pat. No. 4,362,265 is another example of a container including top and bottom members which are fabricated from a common blank to be reversible. Each tray is provided with a pair of upstanding, opposed end walls of one height and adjacent upstanding, opposed sidewalls having a lower height. To package an article, the trays are oriented with their openings facing and are then rotated 90° with respect to each other and brought together so that the higher end walls of one tray overlap and telescope over the shorter sidewalls of the other to complete the container.

In U.S. Pat. No. 4,474,324 there is shown another telescoping carton wherein the tray and cover pieces can be formed from the same blank. The blanks for the pieces are provided with additional score lines so that the corners of the piece serving as the tray piece can be "pinched" together to permit the cover to telescope over the tray piece.

U.S. Pat. No. 4,470,538 is a further example of a carton having identical, tray-like components. Each component is adapted for hingeable and latchable attachment. According to the patentee, since the components are identical, they are nestable, stackable and interchangeable.

U.S. Pat. No. 4,444,354 shows yet another tray and telescoping cover formed from similar blanks. Still other containers and food cartons are shown in U.S. Pat. Nos. 3,926,362; 4,431,128; and 4,339,068.

SUMMARY OF THE INVENTION

The container according to the present invention comprises two complementary container pieces namely, a tray and a cover which is closable over the tray. Each of the two complementary pieces has a plurality of sidewalls connected to a bottom wall. The sidewalls have central portions. Each complementary piece has at least a first pair of opposing sidewalls which have tab portions that extend upwardly to an elevation above the central portions of their adjacent sidewalls. The tab portions have tip portions that project outwardly past these adjacent sidewalls, which do not have tab portions, so that each tip portion projects through a plane of such adjacent sidewall. Each tip portion has a beveled or tapering side edge for facilitating locking together of the two complementary container pieces.

Since the sidewalls of the complementary pieces taper outwardly from the bottom thereof, the tab portions of each piece telescope over the sidewalls, without tab portions, of the complementary piece. The tip portions also have underedges which, when the two complementary container pieces are locked together, resist accidental opening of the container by coming into abutment. Due to the inherent flexibility of the preferred materials from which the container pieces according to the present invention are constructed, the resistance to accidental opening provided by the interlocked pieces does not hinder authorized opening of the closed container. The tray and cover can be opened by finger force applied to pull apart the interlocked tip portions.

Further according to the present invention, either or both of the complementary container pieces may be provided with one or more transversely-extending reinforcing members. Preferably, the reinforcing member extends from the top edge of one sidewall, across the bottom wall and up to the top edge of the opposite sidewall to provide added strength for each such reinforced piece.

A container in accordance with the present invention comprises a tray piece and a cover piece closable over such tray. The pieces each include a bottom wall and upstanding sidewalls connected to the bottom wall. The sidewalls have central portions and two opposing sidewalls of each piece have portions that extend upwardly from the central portions thereof. The upwardly extending portions each have tip portions that project outwardly therefrom through planes determined by the central portions of sidewalls adjacent each sidewall having such an upwardly extending portion.

BRIEF DESCRIPTION OF THE DRAWINGS

Further aspects and features of the invention will become even more apparent from the following claims and the detailed description and drawings wherein like parts are given like reference numerals. In the drawings:

FIG. 6 is a plan view of a modified paperboard blank for forming a tray or cover piece for a container according to a alternative embodiment of the present invention; and FIG. 7 is a perspective view of a container piece formed from the blank shown in FIG. 6.

DETAILED DESCRIPTION OF THE PREFERRED EMBODIMENTS

Figure 1:
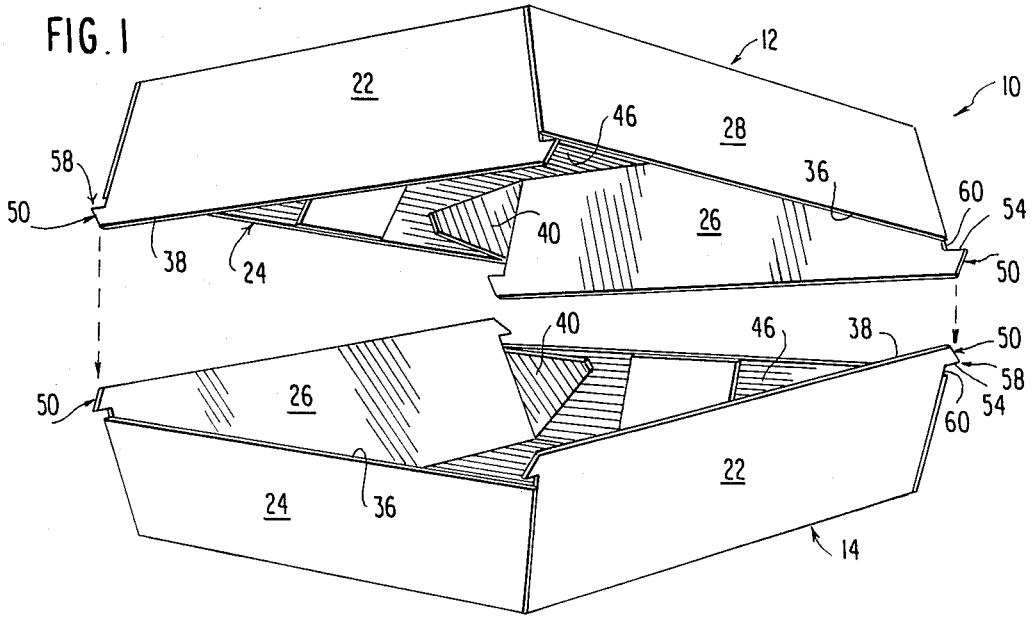
FIG. 1 is a perspective view of a container according to the present invention including a cover piece and a complementary tray piece in accordance with the present invention.

With reference to FIG. 1, there is shown a composite container 10 including two complementary container pieces, hereinafter referred to as cover piece (cover) 12 and tray piece (tray) 14. Preferably, both are formed from paperboard, corrugated paper, metal foil, plastic sheet material, foamed plastic or any other material well known to those of ordinary skill in the art for fabricating containers for food or the like. In the preferred construction where container pieces 12 and 14 are fabricated from paperboard and corrugated paper, the pieces have a single-face construction with a flat paperboard sheet providing the outer surfaces of each container piece and the corrugated sheet providing the inner surfaces. For reasons to be discussed in the following, the selected material should be somewhat flexible and resilient but should still provide the requisite strength for protectively enclosing contents such as food items.

Figure 2:
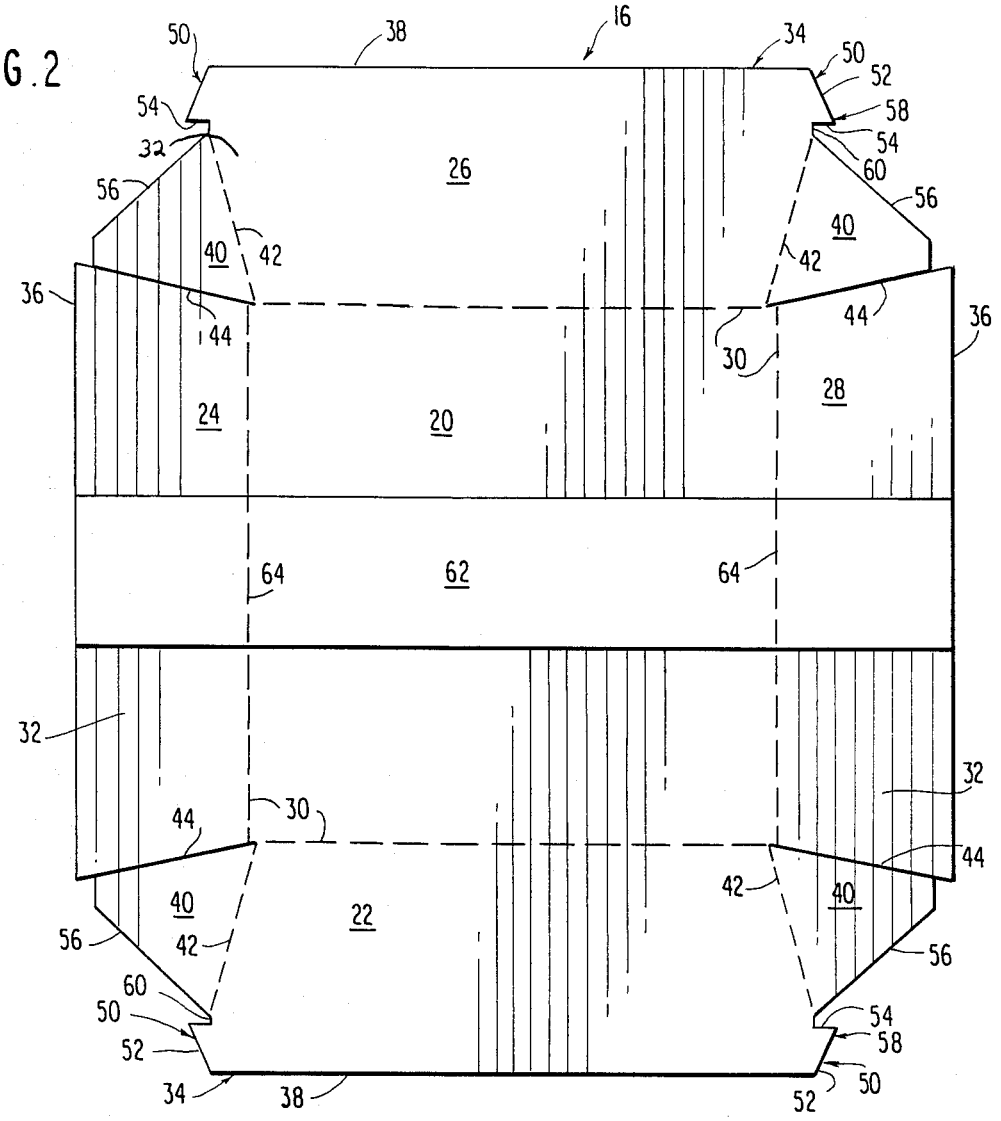
FIG. 2 is a plan view of a blank for forming the two complementary pieces of the container shown in FIG. 1.

As seen from FIG. 1, cover 12 and tray 14 have the same size and shape and indeed, the two pieces 12 and 14 of preferred container 10 are constructed from identical blanks of the type shown in FIG. 2. Blank 16 is "squared-up", that is, folded and secured by adhesive bonding or the like, to form each of the complementary pieces 12 and 14 shown in FIG. 1. Any conventional adhesive can be used in squaring up blank 16. The squared-up pieces 12 and 14 are interchangeable. Furthermore, the preferred container pieces 12 and 14 are nestable so that they can be tightly stacked when not in use. Where blank 16 is formed from paperboard, the paperboard could be of single flute construction or of any other conventional paperboard construction.

In the following, as is now apparent, the features to be described in connection with blank 16 in FIG. 2 and/or either of container pieces 12 or 14 are common to both the blank and pieces 12 and 14. Accordingly, like reference numerals will be used to identify like parts in FIGS. 1 and 2 as well as in FIGS. 3 through 5A.

Blank 16 includes a bottom wall 20 and four sidewalls 22, 24, 26 and 28 connected to the bottom wall. Sidewalls 22 through 28 are delineated from bottom wall 20 by fold or score lines 30 to give bottom wall 20 a generally rectangular, preferably a square, shape. Each of sidewalls 22 through 28 in turn has a generally trapezoidal central portion 32. In addition, opposing sidewalls 22 and 26 also include tab portions 34 that extend upwardly to a height above the top edges 36 of sidewalls 24 and 28 when blank 16 is squared-up (FIG. 1). Tab portions 34 provide the longitudinally extending top edges 38 of sidewalls 22 and 26. Sidewalls 22 and 26 are further provided with glue flaps 40 defined by fold or score lines 42 generally extending from the corners formed by intersecting fold or score lines 30. Glue flaps 40 are separated from sidewalls 24 and 28 by cut lines 44. Alternatively, the glue flaps could be provided on sidewalls 24 and 28 as well.

When blank 16 is to be squared-up, sidewalls 22 through 28 and the four glue flaps 40 are folded along their respective fold or score lines. Then, glue flaps 40 are adhered by a conventional adhesive or otherwise suitably attached to the inner faces of adjacent sidewalls 24 and 28 as seen in FIG. 1. When squared-up, each of the sidewalls 22 through 28 preferably forms an obtuse angle with the bottom wall 20 so that the sidewalls taper outwardly from their attachment to bottom wall 20. As a result, the perimeter of an opening or mouth 46 defined by the top edges 36 of sidewalls 24 and 28 and top edges 38 of sidewalls 22 and 26 exceeds the perimeter of bottom wall 20 as defined by fold or score lines 30. So configured, the complementary pieces 12 and 14 are nestable. On the other hand, the sidewalls of each pair of adjacent sidewalls, for example sidewalls 22 and 24, meet at approximately right angles to form corners.

Each tab portion 34 has two tip portions 50 at its opposite longitudinal ends to give the tab portion a longitudinal length exceeding that of the generally trapezoidal central portion 32 from which it extends. As appreciated from FIG. 1, when cover 12 and tray 14 are formed by squaring-up blank 16, each tip portion 50 projects outwardly to intersect and pass through a plane of a sidewall (i.e., sidewall 24 or 28) adjacent the sidewall (22 or 26) having the tip portion. The tip portions 50 of sidewalls 22 and 26 project outwardly beyond their adjacent sidewalls 24 and 28 lacking such tab portions. Since tip portions 50 are formed as a part of tab portions 34, the tip portions also are elevated with respect to adjacent sidewalls 24 and 28.

Tip portions 50 each have a beveled or tapering side edge 52 that intersects the top edge 38 of their tab portions 34. Beveled side edge 52 also intersects a generally horizontal underedge 54 which, in the embodiment of FIGS. 1 through 5, is parallel to the top edge 38 to form corners 58. Underedges 54 do not necessarily have to be parallel with top edge 38 and could have, for example, a downward slope parallel to the upper edges 56 of glue flaps 40. Then the corners provided by the intersecting side and underedges would be positioned somewhat lower than corners 58 as shown. In the preferred embodiments, there is also a slight clearance 60, generally in the vertical direction, between each tip portion 50 and the glue flap 40 immediately beneath it.

As seen from FIGS. 1 or 2, preferred cover 12 and tray 14 also could include a reinforcing member 62. Depending upon the thickness and strength of the material used to form cover 12 and tray 14, either of these container pieces could have the reinforcing member 62, or alternatively, the reinforcing member could be omitted altogether. Reinforcing member 62 comprises a flat, generally rectangular strip such as a paperboard strip or any other flat strip providing added strength for the "squared-up" cover and/or tray 12 and 14. In the preferred embodiment, reinforcing member 62 is glued to the desired container piece 12 and/or 14 and extends from the top edge 36 of sidewall 24 to the top edge of its opposite sidewall 28. Accordingly, reinforcing member 62 is provided with corresponding fold or score lines 64 which align with the fold or score lines 30 bordering bottom wall 20. Alternatively, reinforcing member 62 might extend only part way up the opposing sidewalls 24 and 28. Also, as apparent to one of ordinary skill in the art, reinforcing member 62 could be oriented to extend between sidewalls 22 and 26 having the tab portions 34 and provide the same desired reinforcement for either container piece. It is also contemplated that a plurality of reinforcing members could be used.

Figure 3:
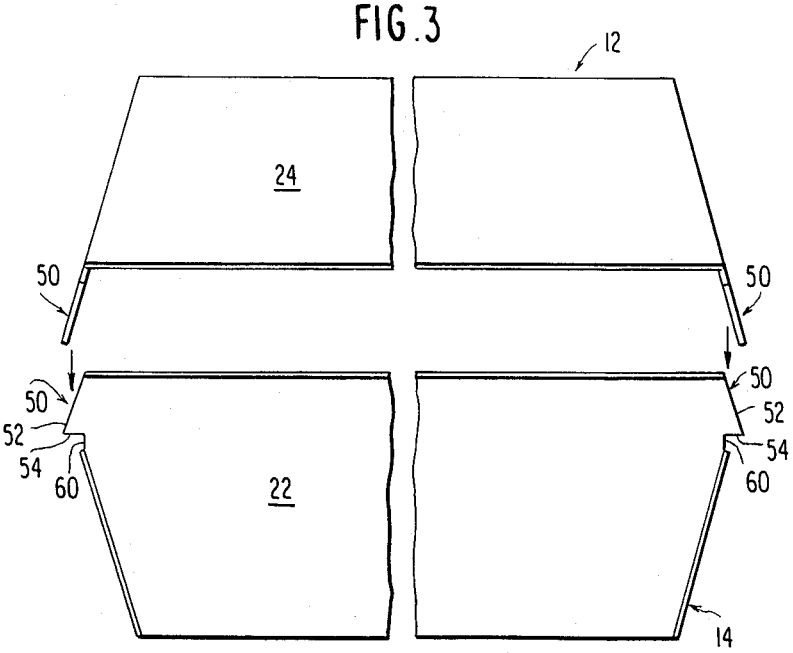
FIG. 3 is an elevated view of the container of FIG. 1 with the complementary cover and tray pieces oriented for closure.
Figure 3A:
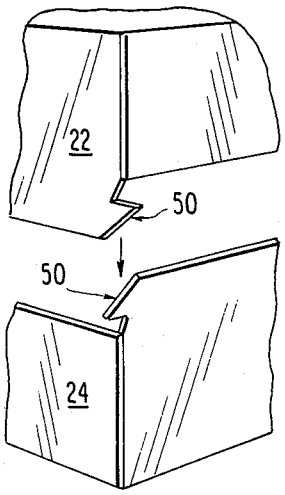
FIG. 3A is a sectional view, in perspective, showing the relationship between tip portions of the cover and tray pieces before the pieces are locked together.

To close container 10 after the desired contents have been placed in tray 14, cover 12 is positioned over tray orientation with respect to the tray so that, as particularly shown in FIGS. 3 and 3A, the sidewalls 22 and 26 having the tab portions 34 of the cover are located immediately above the sidewalls 24 and 28 of the tray and vice versa. Thereafter, all that is needed is to press the tray and cover pieces 12 and 14 together. Since the tab portions 34 of each complementary piece 12 and 14 extend upwardly and outwardly further than their sidewalls 24 and 28 and since all the sidewalls of each piece taper outwardly, the tab portions of each piece will telescope over the sidewalls 24 and 28 of the complementary piece when container 10 is closed.

Figure 4:
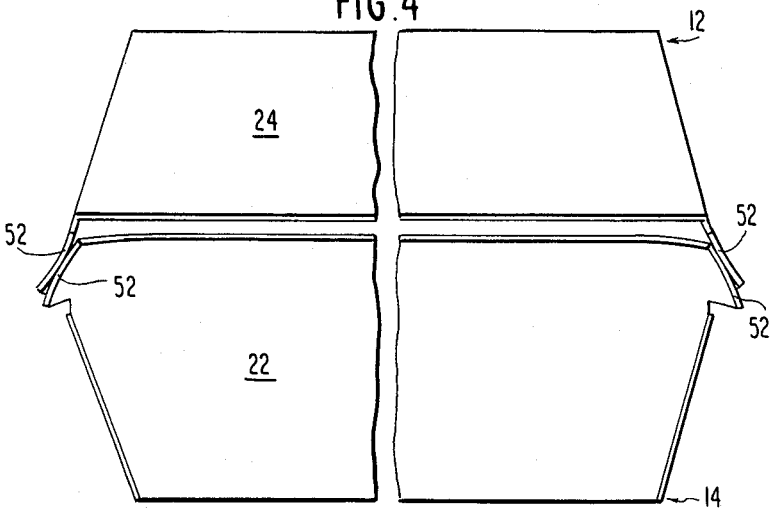
FIG. 4 is a view, similar to FIG. 3, wherein the tray and cover are shown as partially interlocked.
Figure 4A:
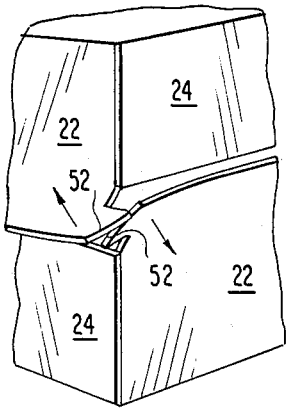
FIG. 4A is a view, similar to FIG. 3A, depicting contacting of the tip portions of the pieces as the cover and tray pieces are partially engaged.
Figure 5:
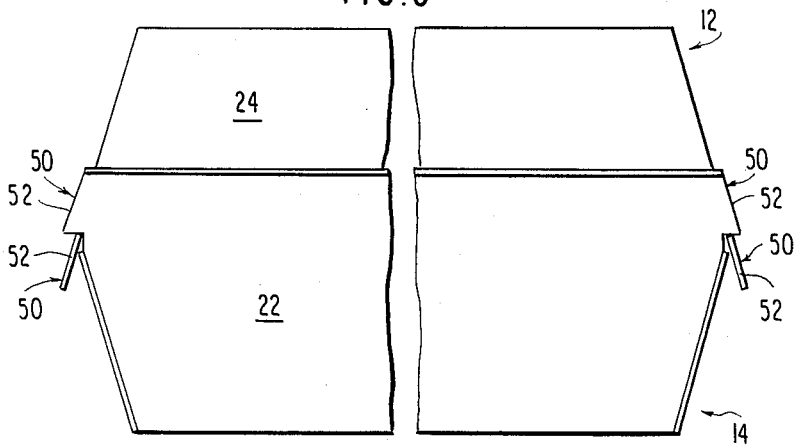
FIG. 5 is a view, similar to FIGS. 3 and 4, of the tray and the cover pieces in their fully interlocked position.
Figure 5A:
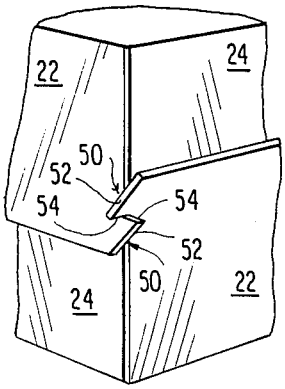
FIG. 5A is a view, similar to FIGS. 3A and 4A, depicting the interrelation of a tip portion of each piece when the complementary tray and cover pieces are fully interlocked.

With reference to FIGS. 4 and 4A, as the facing complementary pieces 12 and 14 are pressed together, the beveled side edges 52 of the two tip portions 50 come into contact and are forced outwardly a indicated by the motion arrows. Since each complementary cover and tray 12 and 14 of container 10 is constructed from a flexible material such as paperboard and/or corrugated paper, tip portions 50 and indeed the tab portions 34 will flex or bend sufficiently to permit the tip portions to slide past one another without damage thereto. With reference to FIGS. 5 and 5A, because the material forming preferred container 10 is also resilient, tip portions 50 quickly return to their unflexed, original shape after the complementary cover 12 and tray 14 have been locked together.

Once pieces 12 and 14 have been locked together to enclose the desired contents, the underedges 54 of the tip portions 50 act to prevent accidental opening of container 10. As seen from FIGS. 5 and 5A, the underedges 54 of the cover 12 oppose the like underedges of the tray 14 in closed container 10. With their underedges so positioned in opposition, tip portions 50 resist undesired separation of the cover and tray 12 and 14 by coming into abutment. Of course, this resistance will not be so substantial as to hinder authorized opening of container 10 because of the inherent flexibility of the materials forming the pieces, but the tip portions 50 do prevent accidental opening of the container. When it is desired to open container 10, this may be done easily by finger force applied to pull the interlocked adjacent tab portions 34 of each container piece 12 and 14 outwardly away from one another. Where container 10 is to be discarded after use, cover and tray pieces 12 and 14 simply may be pulled apart by hand force applied in opposite directions without regard to damaging tip portions 50.

In FIG. 6 there is shown a modified form of a blank 16' according to the present invention. When squared up blank 16' forms a complementary container piece 12'/14' shown in perspective in FIG. 7. Blank 16' has a contour generally similar to that of blank 16, with some slight variations. Preferably, blank 16' is used to form a larger container piece 12'/14' for packaging somewhat larger articles requiring additional space, such as fried chicken or the like.

Since blank 16' frequently will have larger dimensions than blank 16 of container 10, it may be cut from a somewhat heavier and stronger paperboard and corrugated paper material having a "double-face" construction wherein a fluted paperboard sheet is sandwiched between two flat paperboard sheets. In contour, blanks 16' and 16 differ primarily at their respective sidewalls. In particular, tab portions 34' of opposing sidewalls 22' and 26' have somewhat different tip portions 50' As best seen from FIG. 6, tip portions 50' of blank 16' have a beveled edge 100' connecting the horizontal, top edge 38' of their tab portion 34' to an edge 102' which is generally perpendicular to top edge 38' . Edge 102' intersects another edge 104' that is generally parallel to top edge 38'. Edge 104' in turn leads to another edge 106' generally in parallel with edge 102'. Edge 106' likewise is provided for assuring a clearance 60' between each of tip portions 50' and edge 56' of the glue flaps 40'. Edges 100', 102', 104' and 106' provide tip portions 50' with shortened, "squared-off" corners 58' rather than the longer "pointed" corners 58 of tip portions 50 of container 10. The squared-off corners 58' facilitate interlocking of two container pieces 12'/14' in view of the extra stiffness characteristic of the heavier paperboard and corrugated papers usually used in constructing larger container pieces 12'/14'. Tip portions 50' likewise project laterally outwardly through the plane of each of sidewalls 24' and 28' when blank 16' is squared-up.

Preferred container piece 12'/14' also could include a reinforcing member 62' (not shown in FIG. 7) which is likewise similar to reinforcing member 62 of blank 16. Member 62' has fold or score lines 64' corresponding to fold or score lines 30' connecting bottom wall 20' to the four sidewalls 22' through 28'.

Two of container pieces 12'/14' interlock as described in connection with container 10 shown in FIGS. 3 through 5A. Tab portions 34', particularly the tip portions 50' thereof, yield to slip past each other as pushing force is applied to urge two complementary container pieces 12'/14' together to enclose the desired contents.

In order to minimize the materials expenses, a container comprised of two pieces formed according to preferred container piece 12'/14' is contemplated. However, the two pieces, while having the same contour, could be constructed from different paperboard and corrugated papers. For instance, for a less expensive container, only the tray might have a double-face construction while the complementary piece providing the cover could have a single-face construction. In such an arrangement, only the cover would require a reinforcing member 62'.

With the objective of minimizing materials costs still in mind, it is also contemplated that where a large volume container is required for relatively light-weight foods such as a salad, both a tray and cover provided by container pieces 12'/14' might have the single-face construction. Then, as seen from FIG. 6, blank 16' for forming the two singleface container pieces also would differ from blank 16 by a slight modification of the two opposing sidewalls 24' and 28'. In blank 16', the central portions 32' of each of sidewalls 24' and 28' have a generally trapezoidal shape but rather than "sharp" corners, the central portions have beveled corners 108' formed by beveled edges 110'.

Where both the tray and cover pieces 12'/14' are provided with the less expensive, single-face construction, it is preferable that the blank 16' forming those pieces have beveled corners 108'. Otherwise, it is optional to provide the central portions 32' with beveled corners 108'. It is appreciated generally, however, that the tray usually will have somewhat more durable construction than the cover so that it can be used as a plate for holding food while the food is being consumed.

Thus, the container piece 12'/14' forming the tray would have a double-face construction while the cover piece may have either single-face or double-face construction as desired. Even though the complementary pieces for providing a container tray and cover might be constructed from somewhat different materials for the purposes of providing a thicker, more durable tray, the dimensions of the blanks 16' for forming each container piece preferably are the same. Thus, the pieces likewise can be nested or stacked until used. Moreover, regardless of the materials used to form the blank 16' for each piece, the pieces can be coated with any known, fluid-resistant coating commonly applied to food containers to make them more resistant to the penetration of fluids such as water, grease or the like.

The container pieces forming the containers according to the present invention are suitable for packaging many different items and in particular, foods served for carry-out. The tray and cover pieces are easily pressed or snapped together and resist accidental separation to ensure protection of the packaged contents until it is desired to open the container. The container pieces can be coated with any conventional coating commonly applied to food containers to make them resistant to grease or the like. Thus, articles such as hamburgers, french fries, fried chicken and other foods commonly served at carry-out restaurants are readily packageable in the containers according to the present invention. Once the cover is removed, the tray piece can be used as a plate for holding the food as it is being consumed.

It is understood by those of ordinary skill in the art that the complementary tray and cover pieces of the container according to the present invention need not be generally rectangular; e.g. square, as shown in the figures, but could have other shapes as well. There are other obvious changes and modifications to the preferred embodiments of the container of the present invention which could be made by one of ordinary skill in the art, but any such changed or modified container would still fall well within the scope of the invention as set forth in the claims.

What is claimed is:

1. A container comprising a tray piece and a cover piece closable over said tray piece,
   said pieces each including a bottom wall and upstanding sidewalls connected to said bottom wall,
   said sidewalls having central portions,
   two opposing sidewalls of each piece having portions extending upwardly from said central portions thereof,
   said upwardly extending portions each having a tip portion projecting outwardly through a plane determined by the central portion of a sidewall adjacent said sidewalls having said extending portions.

2. A container as claimed in claim 1, wherein each of said extending portions is formed as an elongate tab portion, each said tab portion having one of said tip portions at each opposite longitudinal end thereof.

3. A container as claimed in claim 2, wherein said pieces are formed of flexible material.

4. A container as claimed in claim 3, wherein said sidewalls of said pieces taper outwardly from said bottom wall and said pieces are nestable.

5. A container as claimed in claim 4, wherein said pieces have identical construction.

6. A container as claimed in claim 2, wherein each of said tip portions has an underedge adapted to abut the underedges of the tip portions of a complementary piece to prevent accidental separation of said pieces of said container.

7. A container as claimed in claim 2, wherein said tip portions have beveled side edges.

8. A container as claimed in claim 2, wherein said tip portions have side edges with a beveled edge section and an edge section which in located below said beveled edge section and is generally perpendicular to top edges of said upwardly extending portions.

9. A container as claimed in claim 2, wherein said central portions of said sidewalls are generally trapezoidal.

10. A container as claimed in claim 9, wherein at least two of said central portions have beveled corners.

11. A container as claimed in claim 10, wherein at least one of said pieces has single-face construction.

12. A container as claimed in claim 1, further comprising reinforcing means secured to said bottom wall and the opposite sidewalls of one of said pieces.

13. A container piece adapted to form a container by interlocking with another similar, complementary piece, said piece comprising:
   a bottom wall;
   upstanding sidewalls connected o said bottom wall;
   a tab portion on a central portion of at least two opposing sidewalls, said tab portions extending to have an elevation above the central portions of adjacent sidewalls without said tab portions; and
   a tip portion located at each of two longitudinal ends of each said tab portion, said tip portions projecting outwardly through planes determined by said central portions of said adjacent sidewalls.

14. A container piece as claimed in claim 13, which is formed of flexible material.

15. A container piece as claimed in claim 13, further comprising reinforcing means secured to said bottom wall and to two opposite sidewalls thereof.

16. A container piece as claimed in claim 13, wherein each of said tip portions has an underedge adapted to abut the like underedge of a complementary piece.

17. A container piece as claimed in claim 13, wherein said tip portions have beveled side edges.

18. A container piece as claimed in claim 13, wherein said tip portions have side edges with a beveled edge section and an edge section which is located below said beveled edge section and is generally perpendicular to top edges of said tab portions.

19. A container piece as claimed in claim 13, wherein said central portions of said sidewalls are generally trapezoidal.

20. A container piece as claimed in claim 13, having single-face construction.

21. A container piece as claimed in claim 13, having double-face construction.

22. A blank for forming a container piece which is adapted to interlock with a complementary piece, said blank comprising:
   a bottom wall section;
   first opposing sidewall sections each having a central portion connected to said bottom wall portion; and
   second opposing sidewall sections each having a central portion connected to said bottom wall portion adjacent said first sidewall sections; said second sidewall sections each having a tab portion on each said central portion thereof, said tab portions each having a tip portion at the longitudinal ends thereof, said tip portions projecting in the longitudinal direction of their respective tab portions to over their respective central portions.

23. A blank as claimed in claim 22, which is formed from paperboard and corrugated paper.

24. A blank as claimed in claim 22, further comprising reinforcing means secured to said bottom wall portion and two opposite sidewall portions.

25. A blank as claimed in claim 22, wherein each of said tip portions has an underedge.

* * * * *